US011946272B1

(12) United States Patent
Newstrom et al.

(10) Patent No.: US 11,946,272 B1
(45) Date of Patent: Apr. 2, 2024

(54) OUTDOOR BURIAL SYSTEM FOR URNS

(71) Applicants: Logan Dean Newstrom, Minneapolis, MN (US); Susan Marie Dunn, Minneapolis, MN (US)

(72) Inventors: Logan Dean Newstrom, Minneapolis, MN (US); Susan Marie Dunn, Minneapolis, MN (US)

( * ) Notice: Subject to any disclaimer, the term of this patent is extended or adjusted under 35 U.S.C. 154(b) by 0 days.

(21) Appl. No.: 17/513,261

(22) Filed: Oct. 28, 2021

(51) Int. Cl.
*E04H 13/00* (2006.01)

(52) U.S. Cl.
CPC ..... *E04H 13/006* (2013.01)

(58) Field of Classification Search
CPC ..... E04H 13/00; E04H 13/006; E04H 13/008
See application file for complete search history.

(56) References Cited

U.S. PATENT DOCUMENTS 4,328,606 A * 5/1982 Nunes ..... A61G 17/007 27/35
4,977,652 A * 12/1990 Graham ..... E04H 13/006 27/35
6,279,212 B1 * 8/2001 Balch ..... E04H 13/008 27/35
7,478,461 B2 * 1/2009 Glass ..... A61G 17/007 27/35
8,966,725 B2 * 3/2015 Langelier ..... A61G 99/00 27/35
9,290,960 B1 * 3/2016 McHale ..... E04H 13/00
2010/0234981 A1 * 9/2010 Turner ..... E04H 13/008 700/215
2013/0185907 A1 * 7/2013 Langelier ..... A61G 17/08 27/1

FOREIGN PATENT DOCUMENTS

DE 425234 C * 2/1926 ..... E04H 13/008
DE 102004024078 A1 * 12/2005 ..... E04H 13/008

* cited by examiner

*Primary Examiner* — Christine T Cajilig
(74) *Attorney, Agent, or Firm* — JOHNSON AND PHUNG; Thomas Phung

(57) ABSTRACT

A non-mechanical outdoor urn burial system that includes a one-piece rigid weather resistant tubular vault directly embedded within an outdoor ground surface with a length of the vault extending perpendicular to the outdoor ground surface, the vault having an open top, a closed end, and an elongated chamber having a dimension configured to support one set of urns completely below the ground surface in a stacked condition wherein access to the chamber is through the open top, a weather resistant cover disposed to close the open top and seal the chamber from environmental conditions, and at least two urns each having a top end and a bottom end and disposed top end-to-bottom end in a stacking yet independently displaceable condition in the chamber with each urn including a slot located proximal the top end to facilitate the independent transfer of the urn within and out from the vault.

12 Claims, 2 Drawing Sheets

OUTDOOR BURIAL SYSTEM FOR URNS

FIELD OF THE INVENTION

This invention relates generally to burial systems and, more specifically to an outdoor burial system for storing urns such as in cemetery plots.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Cremation has become a popular alternative to burial in recent years. Although the ashes from the cremation may sometimes be scattered per the wishes of the decreased, it is more common to store cremated remains in an urn for memorialization purposes, whether it's within an individual's residence, in depositories, memorial holders or structures called a columbarium, which is a wall in a building containing a series of recesses for holding the urns.

Urns have also been buried in the ground in the same manner that coffins are buried. However, burying urns in the conventional burial style requires the inefficient use of cemetery land, the cost associated with those burial plots, and the potential difficulties in finding the desired burial plot due to their scarcity especially as family members wish to be cremated and buried close to each other.

The present invention attempts to solve the above problems by providing for an outdoor burial system for storing multiple urns in an end-to-end condition while reducing the plot size that is normally associated with a conventional burial plot.

SUMMARY OF THE INVENTION

Briefly, the present invention comprises a non-mechanical outdoor urn burial system that includes a one-piece rigid elongated weather resistant tubular vault directly embedded within an outdoor ground surface with a length of the vault extending perpendicular to the outdoor ground surface. This includes an open top, a closed end, and an elongated chamber having a dimension configured to support one set of at least six urns at least eighteen inches below the outdoor ground surface in a stacked condition wherein access to the chamber is through the open top.

The outdoor urn burial system also includes a weather resistant cover disposed to close the open top and seal the chamber from environmental conditions and at least two urns each having a top end and a bottom end with the urns disposed top end-to-bottom end in a stacking yet independently displaceable condition in the chamber with each of the urns including a hook loop or a handle located proximal to the top end of the urn to facilitate the independent transfer of the urn within and out from the vault. The elongated weather resistant vault may either be embedded partially or completely under the outdoor ground surface.

Each of the urns may include a male protrusion extending from the top end and a female indentation located at the bottom end with the male protrusion mateable with the female indentation of an adjacent urn to facilitate the stacking of the urns within the chamber.

The outdoor urn burial system may also include at least one removable urn spacer disposed inside the chamber to maintain separation between a plurality of urns with the spacer including a male protrusion extending from a top end and a female indentation located at a bottom end of the urn spacer with the male protrusion and a female indentation of the urn spacer mateable with the corresponding male protrusion and a female indentation of the urns.

The outdoor urn burial system may further include an information displaying plaque attached to an exterior surface of the cover of the vault and the chamber of the elongated weather resistant vault having a diameter of 10 inches or less.

BRIEF DESCRIPTION OF THE DRAWINGS

FIG. 7 is a partial side view of the non-mechanical outdoor urn burial system of FIG. 6.

DESCRIPTION OF THE PREFERRED EMBODIMENT

Figure 1:
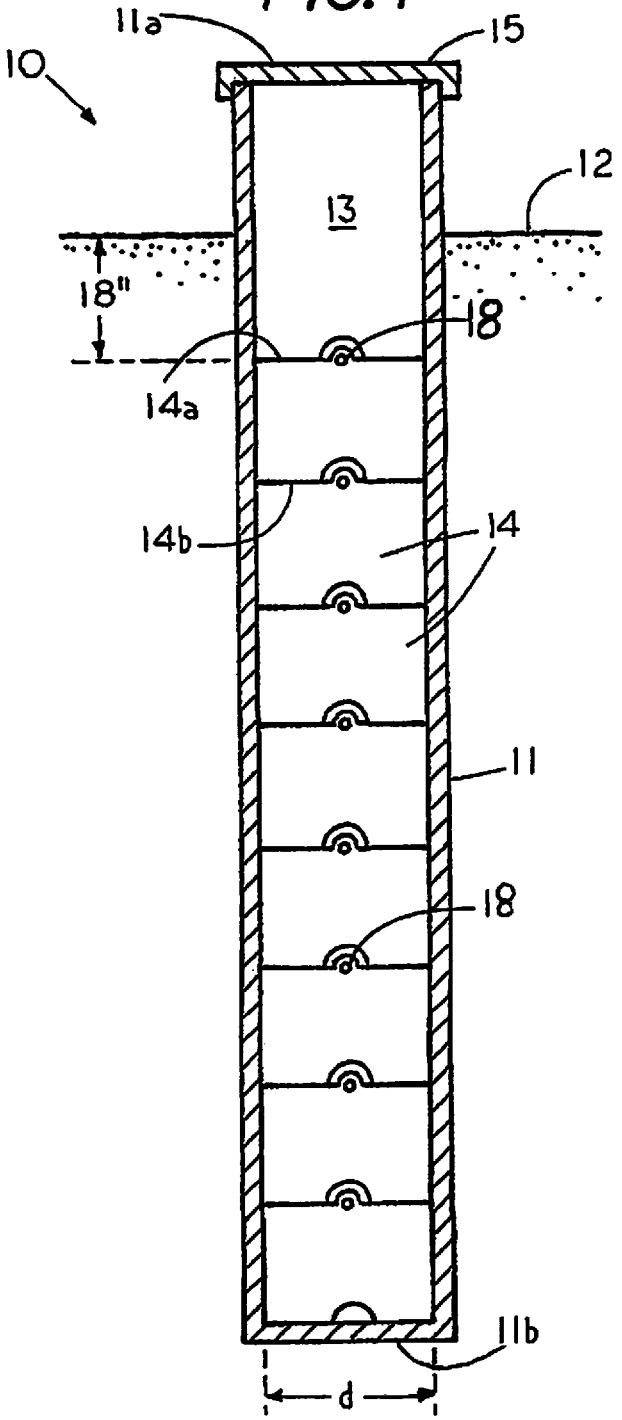
FIG. 1 is a cross-sectional view showing general components of a non-mechanical outdoor urn burial system of the present invention.

The general purpose of the present invention, which will be described subsequently in greater detail, is to provide an outdoor burial system for storing multiple urns in an end-to-end condition while reducing the plot size that is normally associated with conventional cemetery burial plots.

There has thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

Referring to the drawings, FIG. 1 is a cross-sectional view showing general components of a non-mechanical outdoor urn burial system 10 of the present invention which generally includes a one-piece rigid elongated weather resistant tubular vault 11 directly embedded within an outdoor ground surface such as the outdoor ground surface 12 of a cemetery plot with a length of the vault 11 extending perpendicular to the outdoor ground surface 12.

Although the elongated weather resistant vault 11 may be made from any type of rigid weather resistant material, the elongated weather resistant vault 11 is preferably made from a corrosion resistant metal, metal alloy, plastic, ceramic, concrete or their various combinations.

Although non-mechanical outdoor urn burial system 10 shows the elongated weather resistant vault 11 at least partially under the outdoor ground surface 12, alternative embodiments of the non-mechanical outdoor urn burial system may include an elongated weather resistant vault embedded completely under the outdoor ground surface 12.

The vault 11 includes an open top 11*a*, a closed end 11*b*, and an elongated chamber 13 having a dimension configured to support one set of urns 14 completely below the ground surface 12 in a vertically stacked condition wherein access to the chamber 13 is through the open top 11*a*. Although the elongated vault 11 and the chamber 13 are both shown in the embodiment of FIG. 1 as having a circular cross-section, alternative embodiments of the present invention may include but is not limited to an elongated vault and a vault chamber having a triangular, rectangular, or square shaped cross-section with the cross-section of the elongated vault being either the same or different from the cross-section of the vault chamber. In addition, although the vault is shown and described as having a closed end, alternative embodiment of the present invention may include a vault having an open bottom end for accommodating "green" burials such as supporting bio-degradable urns including but not limited to urns made from bamboo therein.

In the embodiment of FIG. 1 the elongated chamber 13 includes a diameter of "d" wherein "d" is slightly larger than a width of the urn supported therein with "d" being 12 inches or less and preferably 10 inches or less. The elongated chamber 13 also includes a length to support at least six and preferably at least 8 urns 14 in a stacking condition completely below the ground surface 12 and preferably with all of the urns 14 supported at least eighteen (18) inches below the outdoor ground surface 12.

The outdoor urn burial system 10 also includes a weather resistant cover 15 disposed to close the open top 11*a* and seal the chamber 13 from environmental conditions and at least two urns 14 each having a top end 14*a* and a bottom end 14*b*, the urns 14 disposed top end-to-bottom end 14*a*, 14*b* in a stacking yet independently displaceable condition in the chamber 13 with each of the urns 14 including a slot 18 located proximal the top end 14*a* of the urn 14 to facilitate the independent transfer of the urn 14 within and out from the chamber 13. Urn 14 may comprise different cross-sectional shapes including but not limited to circular, triangular, square, and rectangular shaped and be made from different types of materials including but not limited to metal, metal alloy, plastics including high density plastic, ceramic, concrete, and their various combinations.

An advantage of the outdoor urn burial system 10 of the present invention is due to the compact design the outdoor burial system 10 allows for the burial of multiple urns in an end-to-end condition while reducing the plot size that is normally associated with a conventional burial plot. For example, the outdoor urn burial system 10 may require as small as 2 feet by 2 feet cemetery property or less compared to the conventional burial plot which are typically sized 3 feet by 9 feet or 4 feet by 10 feet.

Figure 2:
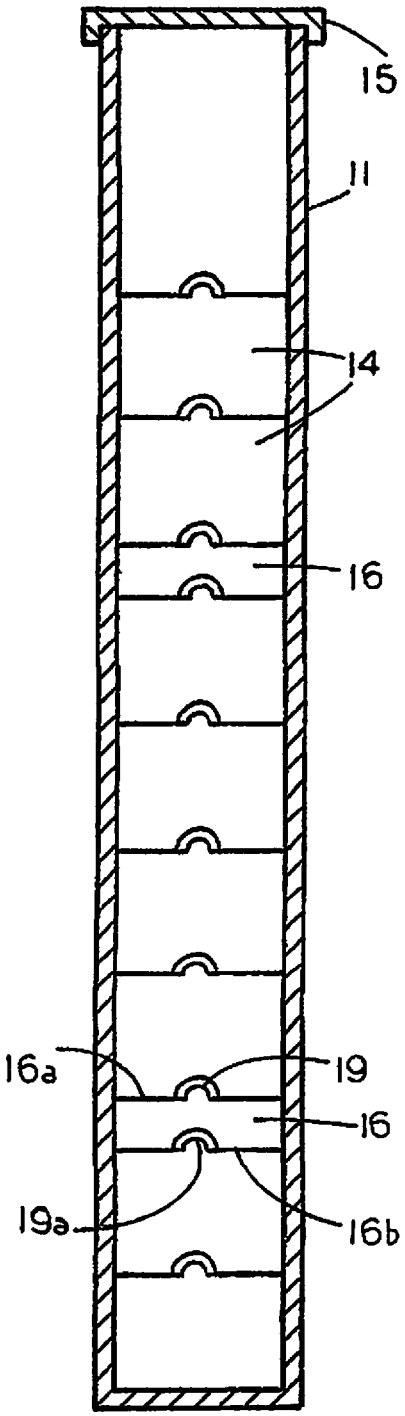
FIG. 2 is a cross-sectional view showing the vault of FIG. 1 supporting urns therein and removable urn spacers for separating at least two of the urns.
Figure 3:
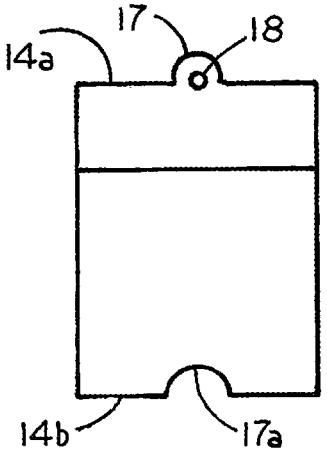
FIG. 3 is a close-up view of the urn of FIGS. 1 and 2.

FIG. 2 is a cross-sectional view showing the vault 11 of FIG. 1 with elongated chamber 13 supporting the urns 14 therein and removable urn spacer 16 disposed inside of the chamber 13 to maintain separation between at least two of the urns 14. FIG. 3 is a close-up view of the urn 14 of FIGS. 1 and 2, which includes a male protrusion 17 extending from the top end 14*a* and a female indentation 17*a* located at the bottom end 14*b* of the urn 14 with the male protrusion 17 mateable with the female indentation 17*a* of an adjacent urn 14 as shown in FIG. 2 to facilitate the alignment and the vertical stacking of the urns 14 within the chamber 13.

Referring back to FIG. 2, the removable urn spacer 16 includes a male protrusion 19 extending from a top end 16*a* and a female indentation 19*a* located at a bottom end 16*b* of the urn spacer 16 with the male protrusion 16*a* and the female indentation 16*b* of the urn spacer 16 mateable with the corresponding male protrusion 17 and a female indentation 17*a* of the urns 14. The spacers 16 may vary in height, and possibly in width, with an example of a suitable height being between 1-4 inches and more preferably 2-3 inches between the spaced urns 15.

Figure 4:
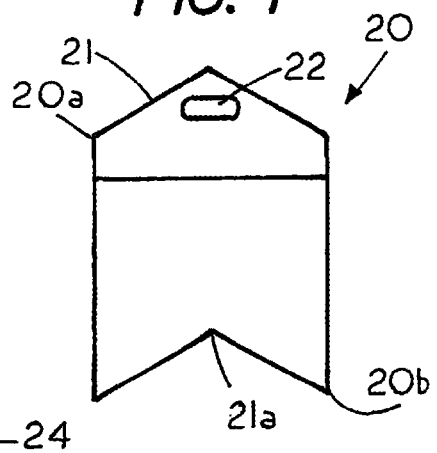
FIG. 4 is a close-up view of an alternative embodiment of an urn.

FIG. 4 is a close-up view of an alternative embodiment of an urn 20 that may be used with the non-mechanical outdoor urn burial system of the present invention, which includes a male tapering protrusion 21*a* extending from a top end 20*a* and a female indentation 21*a* located at a bottom end 20*b* of the urn 20 with the male protrusion 17 mateable with the female indentation 17*a* of an adjacent urn 20 to facilitate the guiding alignment and vertical stacking of the urns 14 within the chamber 13.

In further regards to urns 14 and 20, urn 14 is shown in FIG. 3 as having a slot comprising a hook loop 18 and urn 20 is shown in FIG. 4 as having a slot comprising a handle 22 to facilitate the transfer of the urns 14 and 20 within and out from the vault 13 such as through the use of various elongated urn transfer tools.

Figure 5:
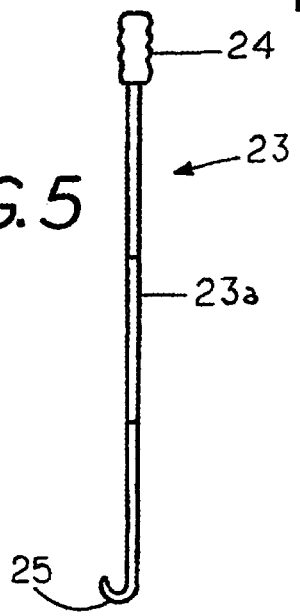
FIG. 5 is a close-up view of a telescoping urn transfer tool that may be used to transfer the urns of FIGS. 3 and 4 within and out from the vault.

FIG. 5 is a close-up view of a telescoping urn transfer tool 23 that may be used to transfer the urns 14 and 20 within and out from the vault 13. As shown, the telescoping urn transfer tool 23 includes an elongated, extendable, and contractable body 23*a* having a handle end 24 and a hook end 25. The hook end 25 is engageable to a slot of an urn such as the hook loop 18 of urn 14 or the handle 22 of urn 20 to facilitate the transfer of the urns 14 and 20 by the user holding the arm end of the telescoping urn transfer tool 23.

Figure 6:
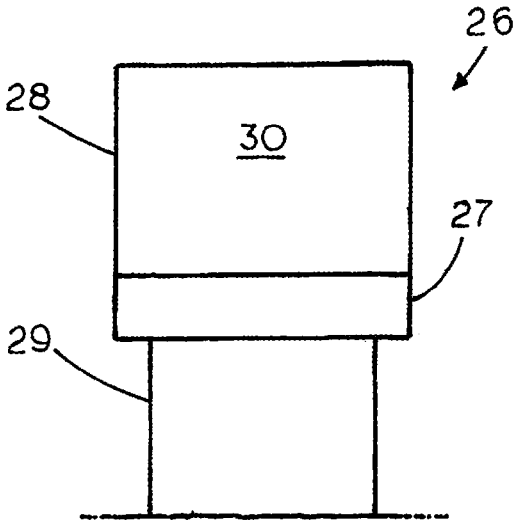
FIG. 6 is a partial front view showing a non-mechanical outdoor urn burial system having an information displaying plaque attached to a cover.
Figure 6A:
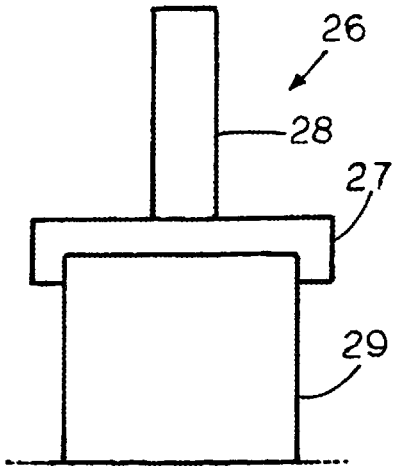

Referring to FIGS. 6 and 6A, FIG. 6 is a partial front view and FIG. 6A is a partial side view showing an alternative embodiment of a non-mechanical outdoor urn burial system 26 having similar components to the non-mechanical outdoor urn burial system 10 of FIG. 1. However, the non-mechanical outdoor urn burial system 26 is shown including a cover 27 having an information displaying plaque 28 attached to an exterior surface of the cover 27 of a vault 29 with the plaque 28 including an information supporting surface 30 located on at least one side of the plaque 28.

The information supporting surface 30 of plaque 28 may include various information about the individuals in the urns supported within the vault including but not limited to the names, life span, age, and relatives of those in the urns. It is noted that although the embodiment of FIGS. 6 and 6A show the plaque 28 as being directly attached to the cover 27, alternative embodiment of the present invention may include a plaque 28 that is spaced from or located adjacent to the cover 27 or attached to an exposed portion of the vault 29.

We claim:

1. A non-mechanical outdoor urn burial system comprising:

a one-piece rigid elongated weather resistant tubular vault directly embedded within an outdoor ground surface with a length of said vault extending perpendicular to said outdoor ground surface and with a portion of said elongated weather resistant vault embedded partially under the outdoor ground surface, said vault having an open top, a closed end, and an elongated chamber having a dimension configured to support one set of urns completely below the ground surface in a vertically stacked condition wherein access to the chamber is through the open top;

a weather resistant cover disposed to close the open top and seal said chamber from environmental conditions;

at least two urns each having a top end and a bottom end, said urns disposed top end-to-bottom end in a stacking yet independently displaceable condition in said chamber with each of said urns including a slot located proximal to said top end of said urn to facilitate the independent transfer of said urn within and out from said vault; and each of said urns includes a male protrusion having a thread-free exterior extending from said top end and a thread-free female indentation located at said bottom end with said male protrusion mateable with said female indentation of an adjacent urn to facilitate the vertical stacking of said urns within said chamber; and at least one removable solid urn spacer disposed inside of the chamber to maintain separation between a plurality of urns, said spacer having a length smaller than a length of each of said urns, said spacer having a thread-free male protrusion extending from a top end and a thread-free female indentation located at a bottom end of said urn spacer with said thread-free male protrusion and said thread-free female indentation of said urn spacer mateable with the corresponding male protrusion and a female indentation of said urns.

2. The non-mechanical outdoor urn burial system of claim 1 wherein said elongated weather resistant vault is made from a corrosion resistant metal, metal alloy, plastic, ceramic, concrete or their various combinations.

3. The non-mechanical outdoor urn burial system of claim 1 wherein said chamber of said elongated weather resistant vault comprises a diameter of twelve inches or less.

4. The non-mechanical outdoor urn burial system of claim 1 wherein said chamber of elongated weather resistant vault supports at least eight urns in a stacking condition completely below the ground surface.

5. The non-mechanical outdoor urn burial system of claim 1 wherein the slot of said urn comprises a hook loop or a handle to facilitate the transfer of said urn within and out from said vault.

6. The non-mechanical outdoor urn burial system of claim 1 wherein said elongated weather resistant tubular vault comprises a circular, triangular, rectangular, or square shaped cross-section.

7. The non-mechanical outdoor urn burial system of claim 1 including an information displaying plaque attached to an exterior surface of said cover of said vault.

8. The non-mechanical outdoor urn burial system of claim 1 wherein all of said urns are supported at least eighteen inches below said outdoor ground surface.

9. A non-mechanical outdoor urn burial system comprising:

a one-piece rigid elongated weather resistant tubular vault directly embedded within an outdoor cemetery plot ground surface with a length of said vault extending perpendicular to said outdoor ground surface and with a portion of said elongated weather resistant vault embedded partially under the outdoor cemetery plot ground surface, said vault having an open top, a closed end, and an elongated chamber having a dimension configured to support one set of at least six urns at least eighteen inches below said outdoor ground surface in a vertically stacked condition wherein access to the chamber is through the open top;

a weather resistant cover disposed to close the open top and seal said chamber from environmental conditions;

at least two urns each having a top end and a bottom end, said urns disposed top end-to-bottom end in a stacking yet independently displaceable condition in said chamber with each of said urns including a hook loop or a handle located proximal said top end of said urn to facilitate the independent transfer of said urn within and out from said vault;

each of said urns includes a male protrusion having a thread-free exterior extending from said top end and a thread-free female indentation located at said bottom end with said male protrusion mateable with said female indentation of an adjacent urn to facilitate the vertical stacking of said urns within said chamber; and at least one removable solid urn spacer disposed inside of the chamber to maintain separation between a plurality of urns, said spacer having a length smaller than a length of each of said urns, said spacer having a thread-free male protrusion extending from a top end and a thread-free female indentation located at a bottom end of said urn spacer with said thread-free male protrusion and a said thread-free female indentation of said urn spacer mateable with the corresponding male protrusion and a female indentation of said urns.

10. The non-mechanical outdoor urn burial system of claim 9 including an information displaying plaque attached to an exterior surface of said cover of said vault.

11. The non-mechanical outdoor urn burial system of claim 10 wherein said chamber of said elongated weather resistant vault a diameter of 10 inches or less.

12. A non-mechanical outdoor urn burial system comprising:

a one-piece rigid elongated weather resistant tubular vault directly embedded within an outdoor ground surface with a length of said vault extending perpendicular to said outdoor ground surface and with a portion of said elongated weather resistant vault embedded partially under the outdoor ground surface, said vault having an open top, a closed end, and an elongated chamber having a dimension configured to support one set of at least six urns at least eighteen inches below said outdoor ground surface in a vertically stacked condition wherein access to the chamber is through the open top;

a weather resistant cover disposed to close the open top and seal said chamber from environmental conditions with said cap located at least two feet above ground to provide user access to said vault chamber;

an information displaying plaque attached to an exterior surface of said cover of said vault;

at least two urns each having a top end and a bottom end, said urns disposed top end-to-bottom end in a stacking yet independently displaceable condition in said chamber with each of said urns including a hook loop or a handle located proximal said top end of said urn to facilitate the independent transfer of said urn within and out from said vault; and each of said urns includes a male protrusion having a thread-free exterior extending from said top end and a thread-free female indentation located at said bottom end with said male protrusion mateable with said female indentation of an adjacent urn to facilitate the stacking of said urns within said chamber and at least one removable solid urn spacer disposed inside of the chamber to maintain separation between a plurality of urns, said spacer having a length smaller than a length of each of said urns, said spacer including a thread-free male protrusion extending from a top end and a thread-free female indentation located at a bottom end of said urn spacer with said male protrusion and a female indentation of said urn spacer mateable with the corresponding male protrusion and a female indentation of said urns.

* * * * *